US006834896B2

(12) United States Patent
Smith

(10) Patent No.: US 6,834,896 B2
(45) Date of Patent: Dec. 28, 2004

(54) LOCKING APPARATUS FOR TRAILER DOORS

(76) Inventor: Barry F. Smith, Box 256, Rd. #1, Roaring Spring, PA (US) 16673

( * ) Notice: Subject to any disclaimer, the term of this patent is extended or adjusted under 35 U.S.C. 154(b) by 21 days.

(21) Appl. No.: 10/270,989

(22) Filed: Oct. 15, 2002

(65) Prior Publication Data

US 2004/0070218 A1 Apr. 15, 2004

(51) Int. Cl.[7] ..... E05C 19/18

(52) U.S. Cl. ..... 292/259 R; 292/288; 292/289; 292/292; 70/14; 70/19

(58) Field of Search ..... 292/259 R, 11, 292/288, 289, 292; 70/14, 19, 211, 212, 202, 203

(56) References Cited

U.S. PATENT DOCUMENTS

| | | | | | |
|---|---|---|---|---|---|
| 909,525 | A | * | 1/1909 | Benton | 292/259 R |
| 2,597,583 | A | * | 5/1952 | Holmsten | 70/89 |
| 3,572,794 | A | * | 3/1971 | Pastva | 292/218 |
| 3,813,117 | A | | 5/1974 | Hackney, Jr. et al. | |
| 4,003,227 | A | * | 1/1977 | Casey | 70/14 |
| 4,068,409 | A | * | 1/1978 | White | 49/367 |
| D249,634 | S | * | 9/1978 | Pastva, Jr. | D8/346 |
| 4,372,136 | A | | 2/1983 | Mickelson | |
| 4,389,862 | A | | 6/1983 | Hastings | |
| 4,391,462 | A | * | 7/1983 | Loreal | 292/207 |
| 4,602,720 | A | | 7/1986 | Mattsson | |
| 4,640,109 | A | | 2/1987 | Schaublin et al. | |
| 4,669,767 | A | * | 6/1987 | Leto | 292/259 R |
| 4,768,816 | A | * | 9/1988 | Bakula | 292/218 |
| 4,958,867 | A | * | 9/1990 | Champagne | 292/259 R |
| 5,082,213 | A | * | 1/1992 | Torres | 244/224 |
| 5,145,222 | A | | 9/1992 | Meyer | |
| 5,165,263 | A | * | 11/1992 | Perron et al. | 70/177 |
| 5,284,036 | A | | 2/1994 | Rosenbaum | |
| 5,340,172 | A | * | 8/1994 | Sweet | 292/259 R |
| 5,388,435 | A | | 2/1995 | Bailey | |
| 5,419,165 | A | * | 5/1995 | Perkins | 70/14 |
| 5,447,346 | A | * | 9/1995 | Virzi | 292/289 |
| 5,507,539 | A | | 4/1996 | Basinski | |
| 5,547,236 | A | * | 8/1996 | Gregory | 292/148 |
| 5,701,768 | A | * | 12/1997 | Khalsa | 70/14 |
| 5,735,146 | A | | 4/1998 | Taplin | |
| 5,865,485 | A | * | 2/1999 | Lawhorne, Jr. | 292/289 |
| 5,934,116 | A | | 8/1999 | Moore | |
| 5,971,450 | A | * | 10/1999 | Suarez | 292/289 |
| 6,112,560 | A | * | 9/2000 | Mabee | 70/14 |
| 6,250,589 | B1 | * | 6/2001 | Russ et al. | 244/224 |
| 6,331,022 | B1 | | 12/2001 | Liroff | |
| 6,412,835 | B1 | * | 7/2002 | Patterson | 292/259 R |
| 6,591,641 | B1 | * | 7/2003 | Cann | 70/14 |

* cited by examiner

*Primary Examiner*—John B. Wall
*Assistant Examiner*—Carlos Lugo
(74) *Attorney, Agent, or Firm*—Benjamin T. Queen, II, Esq.; Pietragallo, Bosick & Gordon

(57) ABSTRACT

A locking apparatus for locking the doors of a cargo container, such as the rear doors of a trailer, is disclosed. The locking assembly may include a second tubular member that telescopes and slides within a first tubular member and an L-shaped assembly mounted on or near the ends of the respective first and second tubular members. The locking apparatus may be placed in a perpendicular fashion between the securing rods of the doors of a cargo container, and the tubular members may be slidably telescoped until the L-shaped assemblies substantially fill the spaces between the cam pins of the securing rods and the walls of the cam pin housings containing the cam pins when the securing rods are in a locked position. In this manner, the cam pins will be prevented from being removed from the cam pin housings, thereby preventing the securing rods from rotating, which in turn keeps the doors of the cargo container securely and tightly locked.

16 Claims, 7 Drawing Sheets

LOCKING APPARATUS FOR TRAILER DOORS

FIELD OF THE INVENTION

The present invention relates to locking devices, and more particularly relates to an apparatus for locking the doors of a trailer.

BACKGROUND INFORMATION

Large enclosed containers for trailers are often used with tractor trucks, railroad flat cars, barges, ships, and the like as a common mode of cargo movement. Large portions of commercial goods are transported in such containers. These goods may range from inexpensive perishables, such as vegetables, to expensive, fragile electronic devices, such as computers. The container itself may be handled by several intermediate transport companies and may be borne by several different vehicles before the goods themselves reach their final destination. For instance, the container may be first borne aboard a tractor trailer, then stacked on an inland waterway barge, then stacked in the hold of an ocean-going ship, later loaded on a railroad flat car, and finally loaded again on a tractor trailer for transport to a local warehouse or store.

The containers themselves often have rear or side doors for access, which are built in accordance with a relatively common standard. These doors normally open outward, and contain large rotating vertical securing rods that are affixed to the doors and can be used to latch and secure the doors in a substantially closed position. One or more of these vertical rods are normally affixed to each door in aligned sockets to permit rod rotation. These vertical rods are normally mounted parallel to one another, and near the edges of the doors where the doors abut together and overlap when in the closed position.

When the rods are rotated to a "closed" position, cam pins near the upper and/or lower ends of the vertical rods latch within and against open box-like receptacles or housings mounted to the top and/or bottom frame edges of the container so that the doors may be tightly closed. Handles on the rods may be pulled upward from their normal positions and then used to rotate the rods. Therefore, when the doors are closed, an operator may rotate the rods to clasp the doors down tightly, lifting the handles when the rods are almost in their locked position and dropping the handles into latches in the face of the trailer door. This latching feature is meant to prevent the vertical rods from rotating once the doors are tightly closed. Padlocks or other similar locking devices are often used to lock these vertical rods into closed position.

Unfortunately, theft has become a major problem with such containers because of the manner in which they are used. Such containers are frequently left unattended for varying periods of time in storage facilities, or on railroad flat cars during transportation from one site to another. Thieves can easily break open the container doors and gain access to the goods inside by using pry bars, hammers, saws and other similar tools to break the locks on the vertical rods, thereby enabling the vertical rods to be pivoted to their open position, and consequently allowing the doors to be opened.

Various devices have been developed in an attempt to make it more difficult to break into such containers. Many of these devices consist of bars or rods that stretch across the doors of the container and lock into place, thereby blocking the doors and keeping them from opening. Some devices actually wrap around at least two of the vertical securing rods, thereby preventing the doors and their respective securing rods from separating. Most of these devices are expensive, cumbersome and difficult to manufacture and use. Furthermore, many of these devices still allow opportunities for thieves to circumvent them and break into the containers.

There is identified, therefore, a need for an improved locking device for the doors of trailers and other storage containers that overcomes disadvantages, shortcomings, or limitations of known locking devices for the doors of trailers and other storage containers.

SUMMARY OF THE INVENTION

An aspect of the invention is to provide an apparatus for locking the doors of a trailer, the doors having at least two securing rods for securing the door to the frame of the trailer, and the securing rods each including at least one cam pin attached near an end of the securing rod and the frame including one cam pin housing for cooperation with at least one of the cam pins. The apparatus includes a first tubular member, and a second tubular member structured and arranged to be received within the first tubular member, wherein the first and second tubular members each include means for engaging the cam pins to substantially prevent movement of the securing rods.

Another aspect of the present invention is to provide a trailer door assembly including at least two securing rods for securing the door assembly to a frame of a trailer, at least one cam pin attached near an end of at least one of the securing rods, at least one cam pin housing for cooperation with at least one of the cam pins, a first tubular member, and a second tubular member structured and arranged to be received within the first tubular member, wherein the first and second tubular members each include means for engaging the cam pins to substantially prevent movement of the securing rods.

A further aspect of the present invention is to provide a method of locking the doors of a trailer, the doors including at least two securing rods for securing the doors to a frame of the trailer, the securing rods each including at least one cam pin attached near an end of a securing rod, and the frame including at least one cam pin housing for cooperation with at least one of the cam pins. The method includes providing a locking apparatus, wherein the locking apparatus includes a first tubular member, a second tubular member structured and arranged to be received within the first tubular member, and wherein the first and second tubular members each include an L-shaped assembly comprising a base plate and a retaining plate extending generally outward from the base plate for engaging the cam pins to substantially prevent movement of the securing rods, placing the first and second tubular members between at least two of the securing rods in a substantially perpendicular position with respect to the securing rods, slidably positioning the first tubular member within the second tubular member so that each retaining plate substantially fills a gap between the cam pin and the wall of the cam pin housing, thereby preventing the cam pin from being removed from the cam pin housing, and securing the second tubular member within the first tubular member in a substantially locked position.

These and other aspects of the present invention will be more apparent from the following description.

DETAILED DESCRIPTION OF THE INVENTION

FIGS. 1*a*–3 illustrate an apparatus for locking the doors of a trailer in accordance with an embodiment of the present invention. Although the apparatus of the present invention is primarily described as being used to lock the doors of a trailer, the apparatus may be used for locking the doors of other cargo containers, such as storage containers transported by boats, trains and other suitable vehicles, and such uses are within the scope of the present invention. As will be described in more detail herein, the locking apparatus may be used to lock the doors of a trailer wherein the doors include at least two securing rods for securing the doors to a frame of the trailer. The securing rods may each include at least one cam pin attached near an end of the rod, and the frame may include at least one cam pin housing for receiving and cooperating with a cam pin. The securing rods may contain handles for causing the rods to rotate, and the rods may be rotated so as to cause a cam pin to be received within a cam pin housing. As the cam pin is received within the cam pin housing, the door will be pulled tightly against the frame of the trailer or other cargo container. The locking apparatus of the present invention may be used to prevent the cam pins from being removed from the cam pin housings, thereby preventing the securing rods from rotating out of the locked position.

Figure 1A:
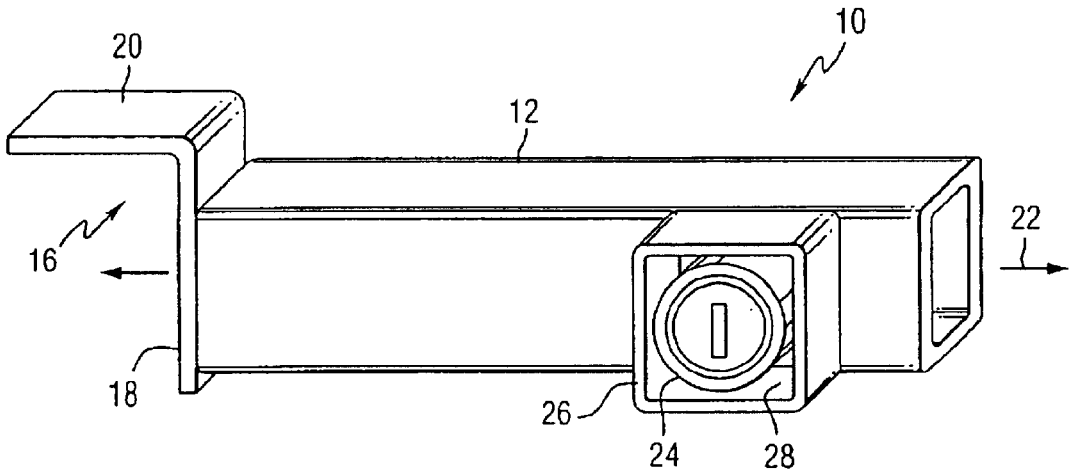
FIG. 1*a* is an isometric view of a portion of a locking apparatus in accordance with an embodiment of the present invention.

FIG. 1*a* shows that the locking apparatus 10 may include a first substantially hollow tubular member 12. The first substantially hollow tubular member 12 may include means for engaging a cam pin 40 or 41 (FIG. 4) to substantially prevent movement of a securing rod 34 or 35 (FIG. 4), such as an L-shaped assembly 16. However, it will be appreciated that other means for engaging a cam pin to substantially prevent movement of a securing rod may be used in conjunction with the invention, as claimed and disclosed herein. More specifically, as illustrated in FIG. 1*a*, the L-shaped assembly 16 may include a base plate 18 and a retaining plate 20 extending generally outward from the base plate 18. As shown in FIGS. 1*a*–3, a longitudinal axis 22 may be defined as an axis that runs substantially parallel to the first substantially hollow tubular member 12 and a second tubular member 14. In this embodiment, the retaining plate 20 of the L-shaped assembly 16 may extend outward from the apparatus in a direction substantially parallel to the longitudinal axis 22. The L-shaped assembly 16 may be attached to the tubular member 12 with any suitable fastening means, such as welding or mechanical fasteners. Alternatively, the L-shaped assembly 16 may be formed as an integral part of the tubular member 12 during manufacture.

Figure 1B:
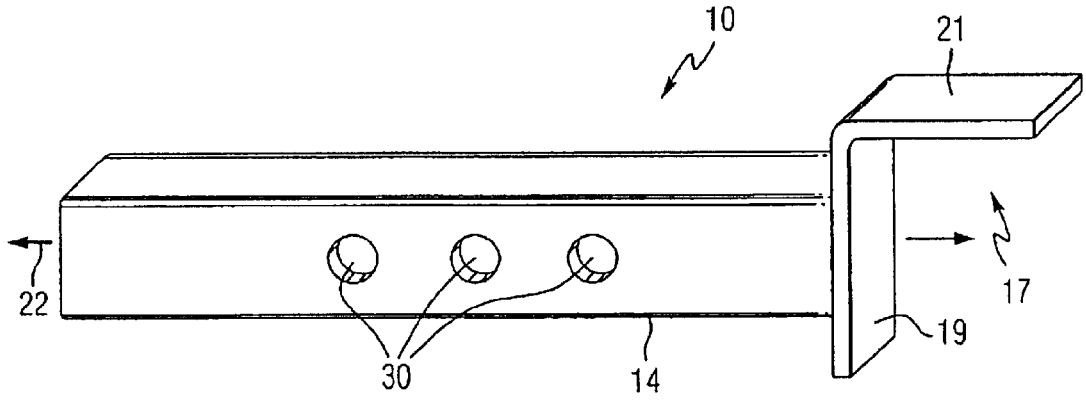
FIG. 1*b* is an isometric view of a portion of a locking apparatus in accordance with an embodiment of the present invention.

FIG. 1*b* shows that the locking apparatus 10 may include a second tubular member 14. The second tubular member 14 may include means for engaging a cam pin 40 or 41 to substantially prevent movement of a securing rod 34 or 35, such as an L-shaped assembly 17. However, it will be appreciated that other means for engaging a cam pin to substantially prevent movement of a securing rod may be used in conjunction with the invention, as claimed and disclosed herein. More specifically, as illustrated in FIG. 1*b*, the L-shaped assembly 17 may include a base plate 19 and a retaining plate 21 extending generally outward from the base plate 19. The retaining plate 21 may extend outwardly from the apparatus 10 in a direction substantially parallel to the longitudinal axis 22 of the apparatus. The L-shaped assembly 17 may be attached to the tubular member 14 with any suitable fastening means, such as welding or mechanical fasteners. Alternatively, the L-shaped assembly 17 may be formed as an integral part of the tubular member 14 during manufacture.

Figure 2:
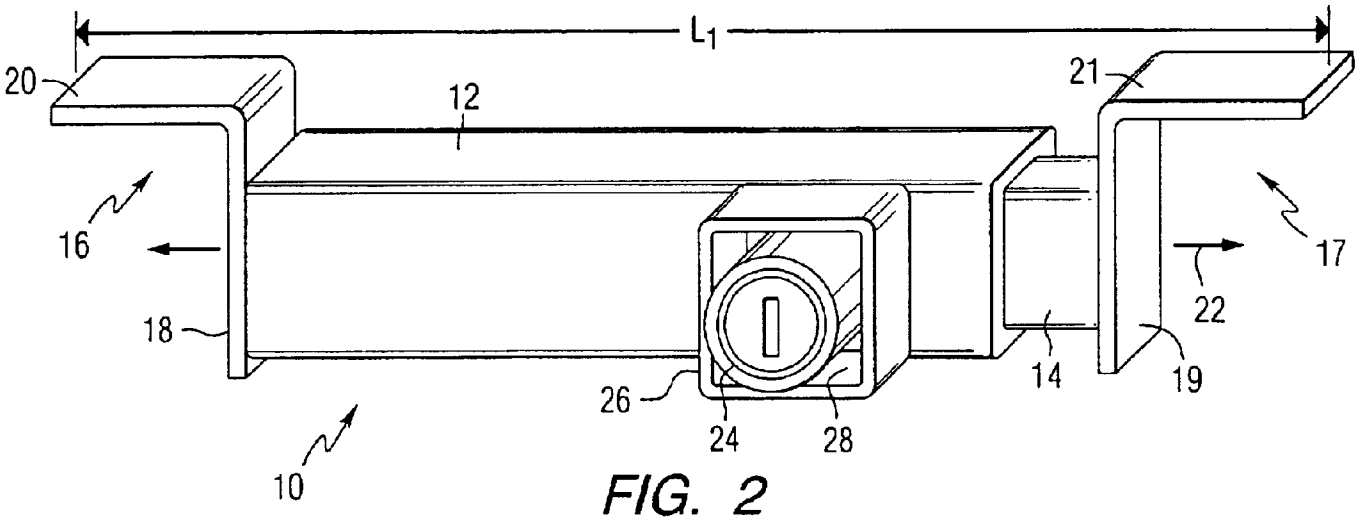
FIG. 2 is an isometric view of a locking apparatus in a substantially unlocked position in accordance with an embodiment of the present invention.
Figure 3:
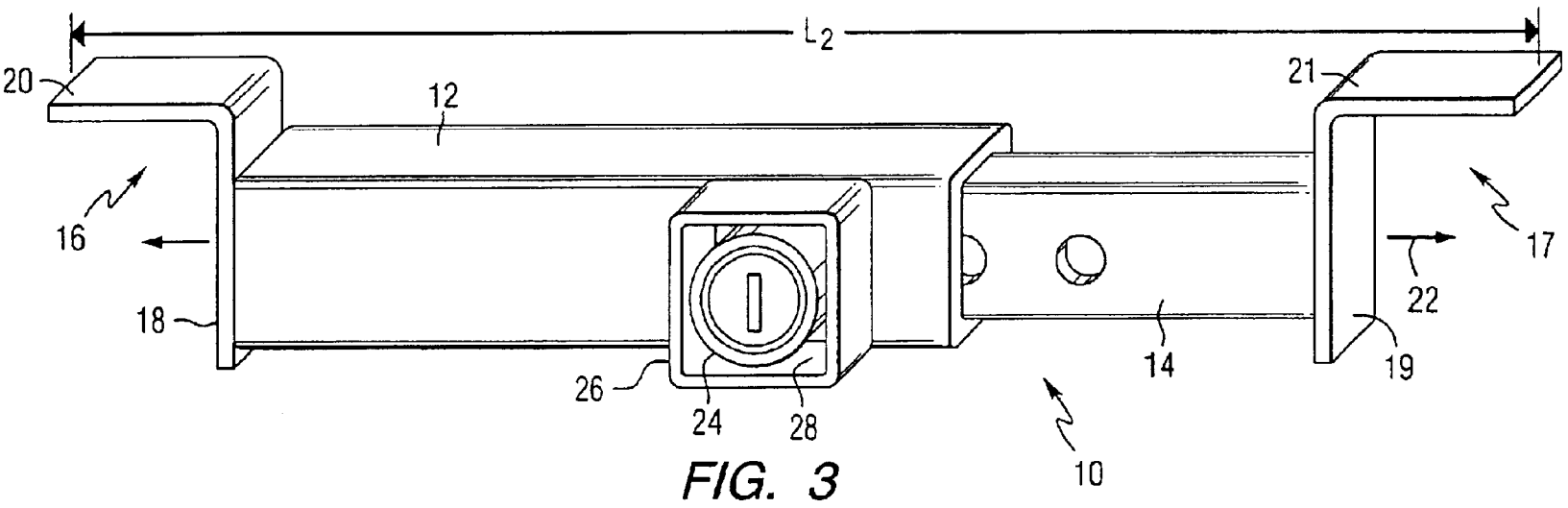
FIG. 3 is an isometric view of a locking apparatus in a substantially locked position in accordance with an embodiment of the present invention.

As shown in FIGS. 2 and 3, the second tubular member 14 may be structured and arranged to be received within the first substantially hollow tubular member 12. As also shown in FIGS. 2 and 3, at least a portion of the second tubular member 14 may be slidably adjustable within the first substantially hollow tubular member 12. As shown in FIG. 2, the second tubular member 14 may be slidably adjusted within the first tubular member 12 to an unlocked position, and as shown in FIG. 3, the second tubular member 14 may be slidably adjusted within the first tubular member 12 to a locked position. However, the "locked" and "unlocked" positions of the tubular members may be completely variable, depending upon, for example, the size and orientation of the door or doors being locked and the position of the securing rods relative to each other. As used herein, "locked position" means that the second tubular 14 member is slidably adjusted within the first tubular member 12 so that the retaining plates 20 and 21 prevent cam pins, such as the cam pins 40 and 41, from being removed from their respective cam pin housings, such as cam pin housings 42 and 43. As used herein, "unlocked position" means that the second tubular member 14 is slidably adjusted within the first tubular member 12 to any position other than a locked position. As shown in FIG. 3, the length $L_2$ of the apparatus in a locked position is greater than the length $L_1$ of the apparatus in an unlocked position, as shown in FIG. 2, with respect to longitudinal axis 22.

As shown in FIGS. 1–3, the locking apparatus 10 may include means for locking the apparatus in a locked position, such as a push-button lock assembly 24. However, it will be appreciated that other means for locking the apparatus in a locked position may be used in conjunction with the invention, as claimed and disclosed herein. In one embodiment, the first tubular member 12 may include a lock housing 26 and the push-button lock assembly 24 may be mounted in a lock-mounting hole 28 formed in the first tubular member 12. As most clearly shown in FIG. 1*b*, the second tubular member 14 may include one or more lock receiving holes 30 for receiving at least a portion of the push-button lock assembly 24.

Figure 4:
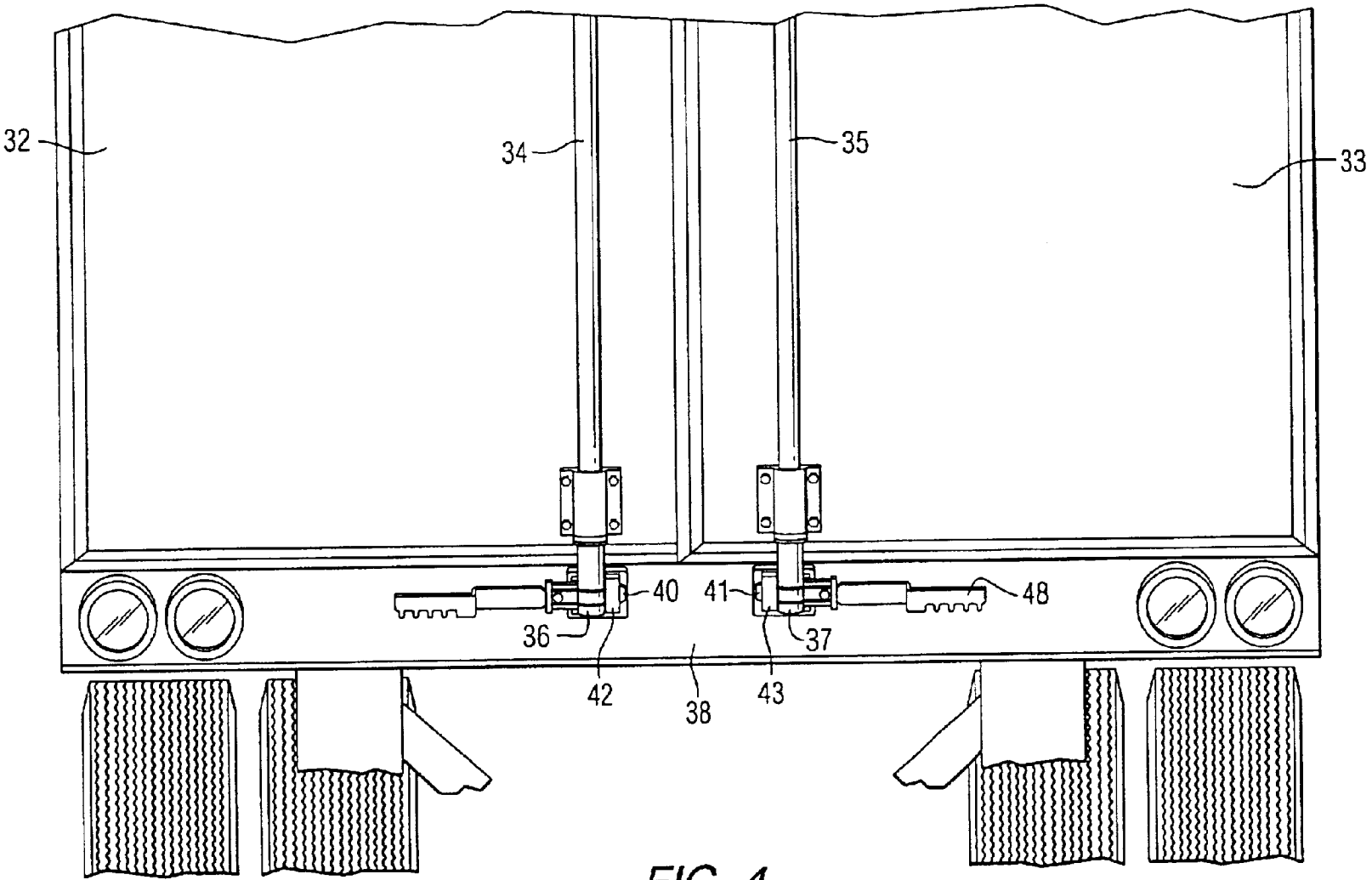
FIG. 4 is a partially schematic view of the rear doors of a tractor-trailer in accordance with an embodiment of the present invention.
Figure 5:
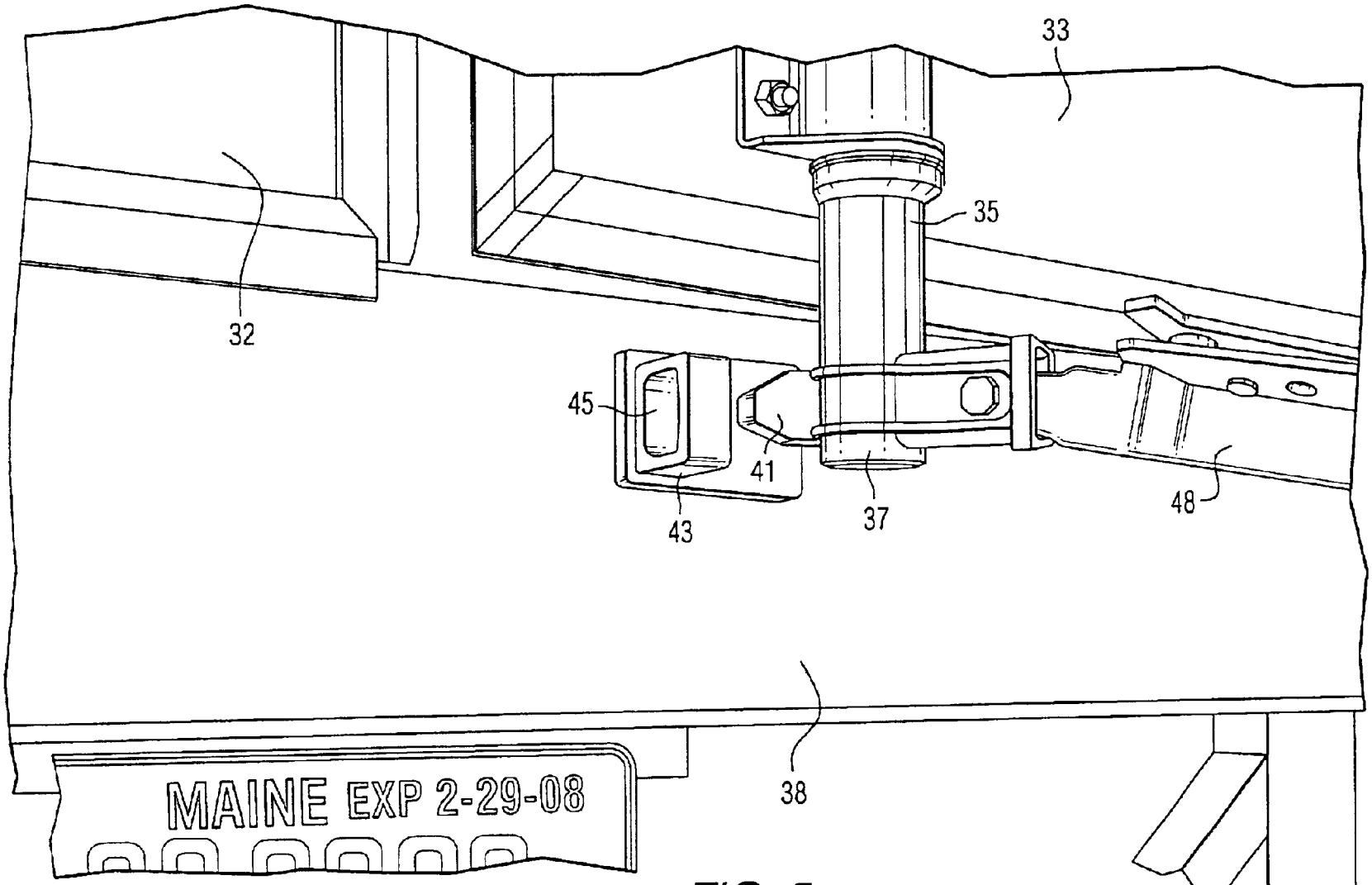
FIG. 5 is a partially schematic view of a portion of the rear door of a tractor-trailer of FIG. 4, showing a portion of a securing rod, a cam pin, and a cam pin housing in accordance with an embodiment of the present invention.

As illustrated in FIG. 4, the locking apparatus 10 of the present invention may be used to lock the doors of a storage container, such as the rear doors 32 and 33 of a trailer. The rear door 32 may include a securing rod 34, including at least one cam pin 40 attached near an end 36 of the securing rod 34, and the frame may include cam pin housing 42 for receiving and cooperating with the cam pin 40 of the securing rod 34. FIG. 4 also illustrates that rear trailer door 33 may include a securing rod 35 having at least one cam pin 41 attached near an end 37 of the securing rod 35. A cam pin housing 43 may be attached to the frame 38 of the trailer for receiving and cooperating with the cam pin 41. Although not shown, securing rods 34 and 35 may include additional cam pins for cooperating with additional cam pin housings attached to other locations on the frame 38. As most clearly shown in FIG. 5, in order to open a door, such as the rear trailer door 33, a securing rod, such as the securing rod 35, may be rotated in a clockwise direction by grasping and pulling the handle 48, thereby causing the cam pin 41 to be released from the opening 45 of the cam pin housing 43, and allowing the trailer door 33 to move freely. To tightly close a trailer door, such as the trailer door 33, the securing rod 35 may be rotated in a counter-clockwise direction by grasping and pushing the handle 48, thereby causing the cam pin 41 to be cooperatively received within the opening 45 of the cam pin housing 43, thereby tightly pulling the trailer door 33 against the frame 38.

Figure 6:
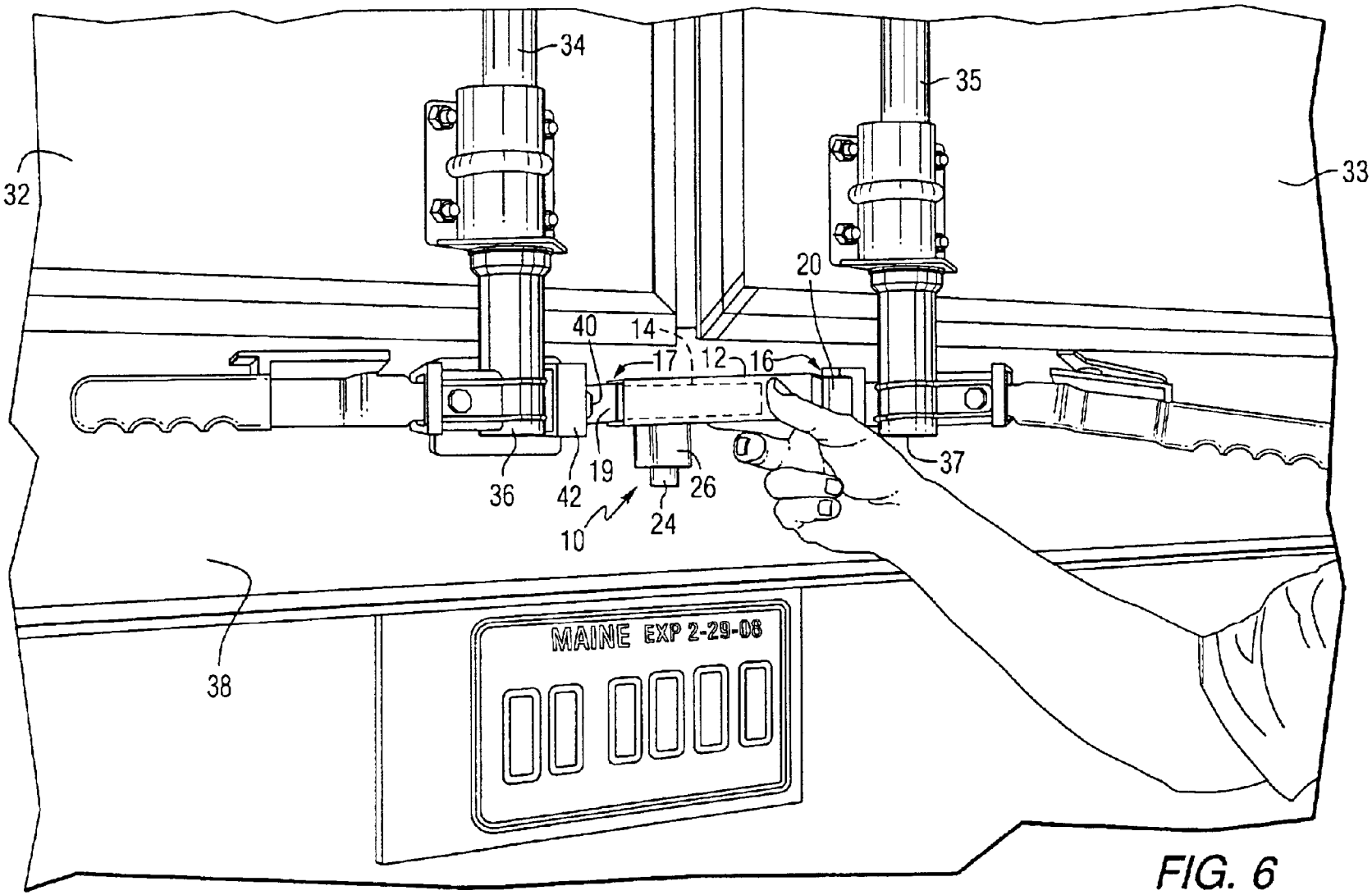
FIG. 6 is a partially schematic view of the rear doors of a tractor-trailer, showing the locking apparatus being placed in position in accordance with an embodiment of the present invention.
Figure 7:
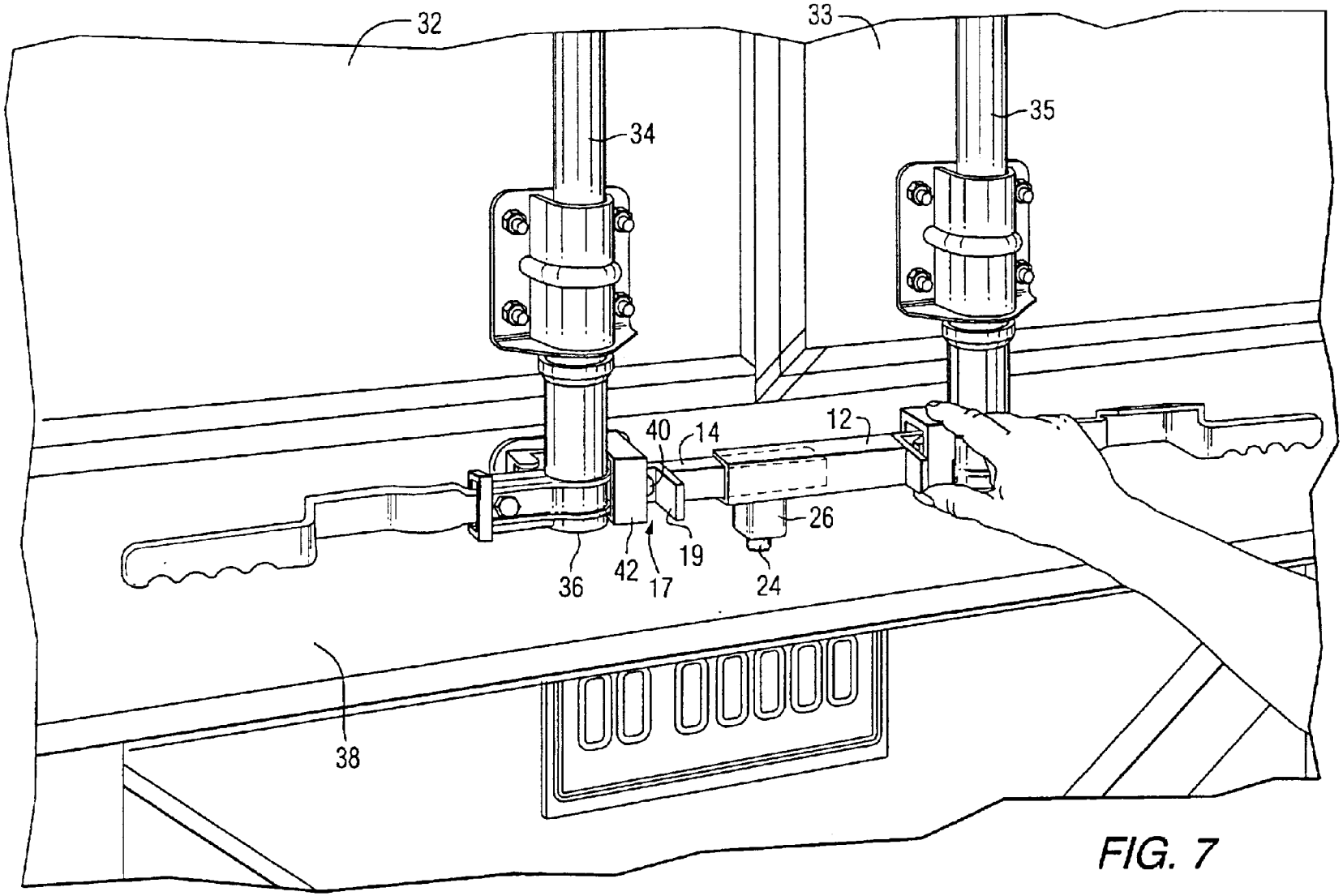
FIG. 7 is a partially schematic view of the rear doors of a tractor-trailer, showing the locking apparatus of FIG. 6 placed in a substantially locked position in accordance with an embodiment of the present invention.
Figure 8:
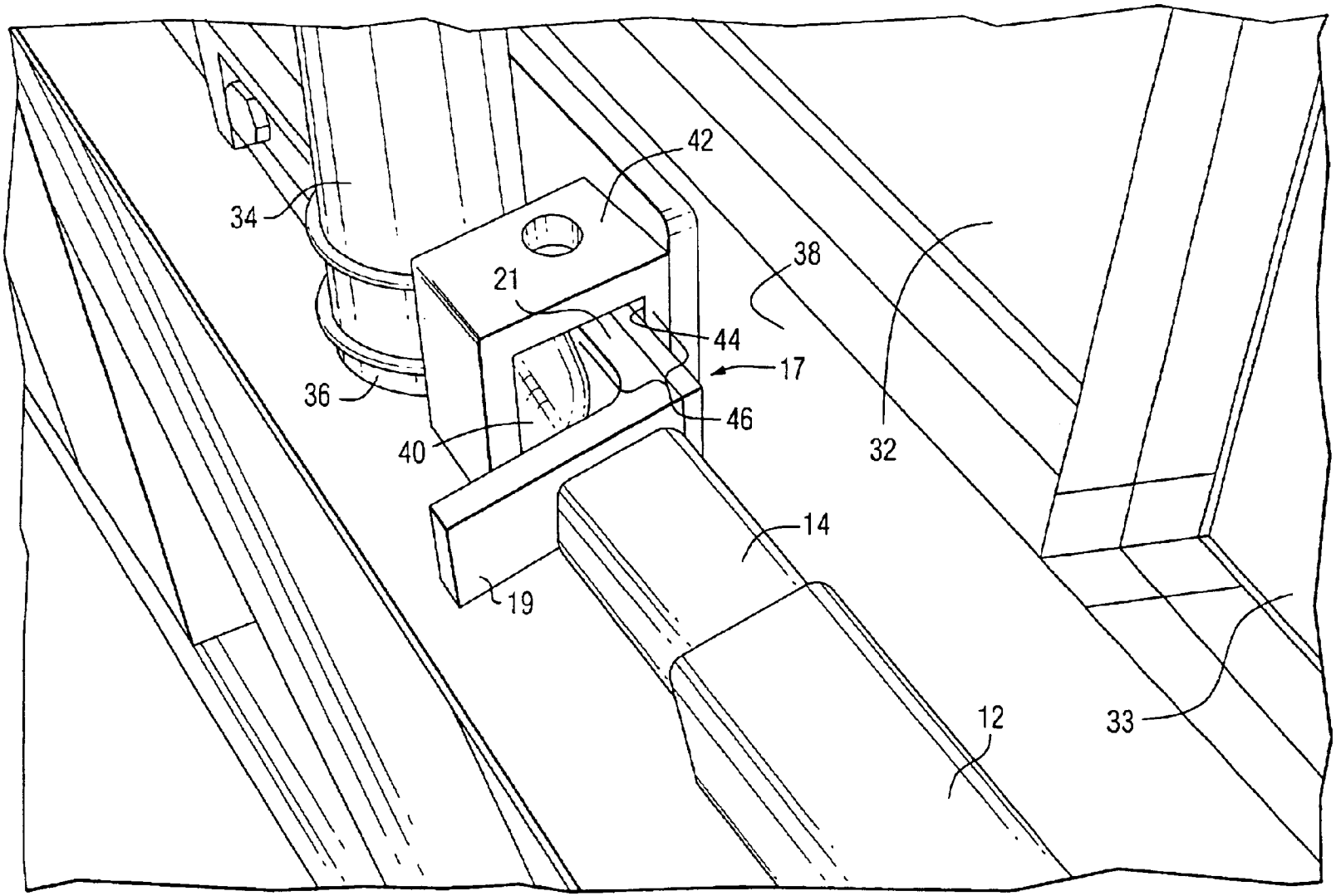
FIG. 8 is a partially schematic close-up view of a rear door of a tractor-trailer, showing a portion of a locking apparatus engaged with a cam pin of a securing rod in accordance with an embodiment of the present invention.

As shown in FIGS. 6–8, the locking apparatus 10 may be used to prevent rear trailer doors 32 and 33 from opening. As shown in FIG. 6, the first tubular member 12 and the second tubular member 14 may be placed between the securing rods 34 and 35 in a substantially perpendicular position with respect to securing rods 34 and 35, and the second tubular member 14 may be slidably positioned within the first tubular member 12 in a locked position so that the retaining plate 21 substantially fills a first gap 46 between the cam pin 40 and a wall 44 of the cam pin housing 42, thereby preventing the cam pin 40 from being removed from the cam pin housing 42, and retaining plate 20 substantially fills a second gap (not shown) between the cam pin 41 and a wall (not shown) of the cam pin housing 43, thereby preventing the cam pin 41 from being removed from the cam pin housing 43, as most clearly illustrated in FIGS. 7 and 8. By preventing cam pins 40 and 41 from being removed from cam pin housings 42 and 43, securing rods 34 and 35 will not be able to rotate, and trailer doors 32 and 33 will be securely and tightly locked.

Once the second tubular member 14 is slidably positioned within the first tubular member 12 so that the cam pin 40 is securely retained within the cam pin housing 42, as shown in FIG. 8, and the cam pin 41 is securely retained within the cam pin housing 43, the locking apparatus 10 will be in a locked position, and the second tubular member 14 may be secured within the first tubular member 12 in this locked position, for example, with the push-button lock assembly 24. In order to remove the locking apparatus 10 from the rear trailer doors 32 and 33, the second tubular member 14 may be slidably positioned within the first tubular member 12 until retaining plates 20 and 21 are substantially removed from cam pin housings 42 and 43. The locking apparatus 10 may then be easily removed, and securing rods 34 and 35 will be free to rotate, thus allowing the rear trailer doors 32 and 33 to open.

In one embodiment, first tubular member 12, second tubular member 14, L-shaped assemblies 16 and 17, and lock housing 26 may be made of metal or metal alloys, such as steel or iron. However, these portions of the locking apparatus 10 may be made out of other suitable materials having the requisite strength and stability, and such materials are within the scope of the present invention.

Whereas particular embodiments of this invention have been described above for purposes of illustration, it will be evident to those skilled in the art that numerous variations of the details of the present invention may be made without departing from the invention as defined in the appended claims.

What is claimed is:

1. A trailer door assembly comprising:

at least two securing rods for securing the door assembly to a frame of a trailer;

at least one cam pin attached near an end of the at least two securing rods;

at least one cam pin housing for cooperation with the at least one cam pin;

a first tubular member; and a second tubular member structured and arranged to be received within the first substantially hollow tubular member, wherein the first and second tubular members each include means for engaging the cam pins to substantially prevent movement of the securing rods.

2. The trailer door assembly of claim 1, wherein the means for engaging the cam pins comprises an L-shaped assembly.

3. The trailer door assembly of claim 2, wherein each L-shaped assembly comprises a base plate and a retaining plate extending generally outward from the base plate.

4. The trailer door assembly of claim 3, wherein the retaining plate is structured and arranged to substantially fill a gap between the cam pin and a wall of the cam pin housing when the second tubular member is slidably positioned within the first substantially hollow tubular member and the first and second tubular members are placed between the at least two securing rods in a substantially perpendicular position with respect to the at least two securing rods, thereby preventing the cam pin from being removed from the cam pin housing.

5. The trailer door assembly of claim 4, wherein the second tubular member may be slidably adjusted within the first tubular member to an unlocked position.

6. The trailer door assembly of claim 4, wherein the second tubular member may be slidably adjusted within the first tubular member to a locked position.

7. The trailer door assembly of claim 6, wherein the assembly includes means for locking the second tubular member within the first tubular member in a locked position.

8. The trailer door assembly of claim 7, wherein the means for locking the second tubular member within the first tubular member comprises a push button lock assembly mounted in a lock-mounting hole formed in the first tubular member.

9. The trailer door assembly of claim 8, wherein the second tubular member includes at least one lock receiving hole for receiving at least a portion of the push button lock assembly.

10. A method of locking the doors of a trailer, wherein the doors include at least two securing rods for securing the doors to a frame of the trailer, the securing rods each including at least one cam pin attached near an end thereof and the frame including at least one cam pin housing for cooperation with the at least one cam pin, the method comprising:

providing a locking apparatus, wherein the locking apparatus includes a first tubular member, a second tubular member structured and arranged to be received within the first tubular member, and wherein the first and second tubular members each include an L-shaped assembly comprising a base plate and a retaining plate extending generally outward from the base plate for engaging the cam pins to substantially prevent movement of the securing rods;

placing the first and second tubular members between the at least two securing rods in a substantially perpendicular position with respect to the at least two securing rods;

slidably positioning the second tubular member within the first tubular member so that each retaining plate substantially fills a gap between the cam pin and a wall of the cam pin housing, thereby preventing the cam pin from being removed from the cam pin housing; and securing the second tubular member within the first tubular member in a substantially locked position.

11. The method of claim 10, wherein the first tubular member is substantially hollow.

12. The method of claim 10, wherein the second tubular member is secured within the first tubular member with means for locking the second tubular member within the first tubular member in a substantially locked position.

13. The method of claim 12, wherein means for locking the second tubular member within the first tubular member comprises a push button lock assembly mounted in a lock-mounting hole formed in the first tubular member.

14. The method of claim 13, wherein the second tubular member includes at least one lock receiving hole for receiving at least a portion of the push button lock assembly.

15. The method of claim 13, wherein the second tubular member includes a plurality of lock receiving holes for receiving at least a portion of the push button lock assembly.

16. The method of claim 10, wherein the length of the apparatus in the locked position is greater than the length of the apparatus in an unlocked position with respect to a longitudinal axis.

* * * * *

UNITED STATES PATENT AND TRADEMARK OFFICE

CERTIFICATE OF CORRECTION

PATENT NO. : 6,834,896 B2
DATED : December 28, 2004
INVENTOR(S) : Barry F. Smith It is certified that error appears in the above-identified patent and that said Letters Patent is hereby corrected as shown below:

Column 7,
Lines 21-22, delete "Claim 11".

Signed and Sealed this

Tenth Day of January, 2006

JON W. DUDAS
*Director of the United States Patent and Trademark Office*